US010843037B2

(12) United States Patent
Gearon

(10) Patent No.: US 10,843,037 B2
(45) Date of Patent: Nov. 24, 2020

(54) CLIMBING EXERCISER

(71) Applicant: Michael James Gearon, Victoria (AU)

(72) Inventor: Michael James Gearon, Victoria (AU)

( * ) Notice: Subject to any disclaimer, the term of this patent is extended or adjusted under 35 U.S.C. 154(b) by 54 days.

(21) Appl. No.: 16/212,904

(22) Filed: Dec. 7, 2018

(65) Prior Publication Data

US 2019/0175982 A1 Jun. 13, 2019

(30) Foreign Application Priority Data

Dec. 8, 2017 (AU) ..... 2017904944

(51) Int. Cl.

*A63B 22/04* (2006.01)
*A63B 21/00* (2006.01)
*A63B 22/00* (2006.01)

(52) U.S. Cl.

CPC ..... *A63B 22/04* (2013.01); *A63B 21/154* (2013.01); *A63B 21/4034* (2015.10); *A63B 21/4035* (2015.10); *A63B 22/001* (2013.01); *A63B 22/0005* (2015.10); *A63B 2022/0043* (2013.01)

(58) Field of Classification Search

CPC ..... A63B 22/0005; A63B 22/001; A63B 22/0664; A63B 22/04; A63B 22/0046; A63B 2022/0043; A63B 21/154; A63B 21/012; A63B 21/4035; A63B 21/4034; A63B 21/4047; A63B 21/4045; A63B 23/03575; A63B 23/0664; A63B 2225/09; A63B 2225/102; A63B 2225/10

See application file for complete search history.

(56) References Cited

U.S. PATENT DOCUMENTS 5,040,785 A 8/1991 Charnitski
5,222,927 A * 6/1993 Chang ..... A63B 21/0552 482/126
5,290,211 A * 3/1994 Stearns ..... A63B 21/00178 482/51
5,492,515 A * 2/1996 Charnitski ..... A63B 22/001 482/37
5,620,400 A * 4/1997 Foster ..... A63B 22/001 482/37
5,928,115 A * 7/1999 Arroyo, Jr. ..... A63B 22/0002 482/51
6,595,899 B2 * 7/2003 Liang ..... A63B 22/0056 482/51
10,179,260 B1 * 1/2019 Stearns ..... A63B 22/04
(Continued)

*Primary Examiner* — Megan Anderson
(74) *Attorney, Agent, or Firm* — Muncy, Geissler, Olds & Lowe, P.C.

(57) ABSTRACT

A climbing exerciser includes a base mount, left and right racks located at left and right sides of the base mount respectively, two left links each having an end pivotally connected with the base mount and the other end pivotally connected with the left rack in a way that the left rack is reciprocatingly moveable up and down, two right links each having an end pivotally connected with the base mount and the other end pivotally connected with the right rack in a way that the right rack is reciprocatingly moveable up and down, and a motion linking device disposed to the base mount and linked with the left rack and the right rack in a way that the right rack lowers when the left rack raises. As such, the climbing exerciser can provide smooth and more natural movements to the user with low noise and various exercise modes.

9 Claims, 4 Drawing Sheets

(56) References Cited

U.S. PATENT DOCUMENTS

| | | | | |
|---|---|---|---|---|
| D853,504 | S * | 7/2019 | Mercenari Uribe | D21/670 |
| 2013/0157812 | A1* | 6/2013 | Chen | A63B 21/068 482/52 |
| 2014/0248998 | A1* | 9/2014 | Lu | A63B 21/154 482/52 |
| 2019/0160331 | A1* | 5/2019 | Mercenari Uribe | A63B 23/03591 |

* cited by examiner

CLIMBING EXERCISER

BACKGROUND OF THE INVENTION

1. Field of the Invention

The present invention relates generally to a fitness equipment and more particularly, to a climbing exerciser.

2. Description of the Related Art

U.S. Pat. No. 5,040,785 (hereinafter referred to "the '785 patent") discloses a climbing exercise machine, which is composed of a vertically extending track structure 103, two foot pedals 114 and 116 slidably arranged at a lower part of the track structure 103, two hand grips 118 and 120 slidably arranged at an upper part of the track structure 103, and a plurality of chains 202, 214, 216 and 218 coupled with the two foot pedals 114 and 116 and the two hand grips 118 and 120 to form a loop structure, as shown in FIG. 7 thereof. With the climbing exercise machine, a user can do a climbing action in a so-called "homolateral pattern", i.e. the left pedal 116 and the left grip 120 synchronously move upward when the right pedal 114 and the right grip 118 synchronously move downward, or a "cross crawl pattern", i.e. the left pedal 116 and the right grip 118 synchronously move downward when the right pedal 114 and the left grip 120 synchronously move upward, as shown in FIG. 2 of the '785 patent. In this patent, to change the climbing action from the homolateral pattern to the cross crawl pattern, the connecting locations of the chains 202 and 218 must be changed to the conditions as shown in FIG. 3 of the '785 patent.

In the '785 patent, the two pedals 114 and 116 and the two grips 118 and 120 are disposed on the track structure 103 by four sliders 142, 144, 146 and 148. When the user operates the climbing exercise machine, the sliders 142, 144, 146 and 148 and the chains 202, 214, 216 and 218 will rub against the track structure 103, which not only increases the resistance but also generates unwanted noise, lowering the value of the product. Further, because the track structure 103 extends in a straight line, the climbing motion provided by the '785 patent to the user is relatively mechanized and consequently less natural. Furthermore, the position of the track structure 103 blocks user's line of sight, giving a strong sense of oppression.

For the climbing exercise machine disclosed by the '785 patent, changing operation mode from homolateral climbing movement to contralateral climbing movement and vice versa is quite complicated and inconvenient because the chains 202 and 218 are concealed inside the track structure 103 and the user must dismantle and then reinstall the chains 202 and 218 in accordance with a required connecting condition.

SUMMARY OF THE INVENTION

The present invention has been accomplished in view of the above-noted circumstances. It is an objective of the present invention to provide a climbing exerciser, which can be operated smoothly and quietly, effectively enhancing the sense of value to a user. Another objective of the present invention is to provide a climbing exerciser that can perform smooth and ergonomic motions, and consequently provide a more natural movement to the user without blocking the user's line of sight. It is still another objective of the present invention to provide a climbing exerciser, which can easily shift exercise mode by simply adjusting the structure thereof.

To attain the above objectives, the present invention provides a climbing exerciser comprising a base mount, a left rack, two left links, a right rack, and two right links. The left rack is located at a left side of the base mount. The two left links each have a first end pivotally connected with the base mount, and a second end pivotally connected with the left rack in a way that the left rack is reciprocatingly moveable up and down relative to the base mount. The right rack is located at a right side of the base mount. The two right links each have a first end pivotally connected with the base mount, and a second end pivotally connected with the right rack in a way that the right rack is reciprocatingly moveable up and down relative to the base mount. As a result, the climbing exerciser can be operated smoothly and quietly so as to enhance the sense of value thereof, and can perform smooth and ergonomic motions, and subsequently provide a more natural movement to the user without blocking the user's line of sight.

In a preferred embodiment, the left rack is composed of a lower left member and an upper left member pivotally connected with the lower left member, and the right rack is composed of a lower right member and an upper right member pivotally connected with the lower right member. By means of adjusting the postures of the upper left and right members relative to the lower left and right members respectively, the climbing exerciser can easily shift exercise mode from one to another.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
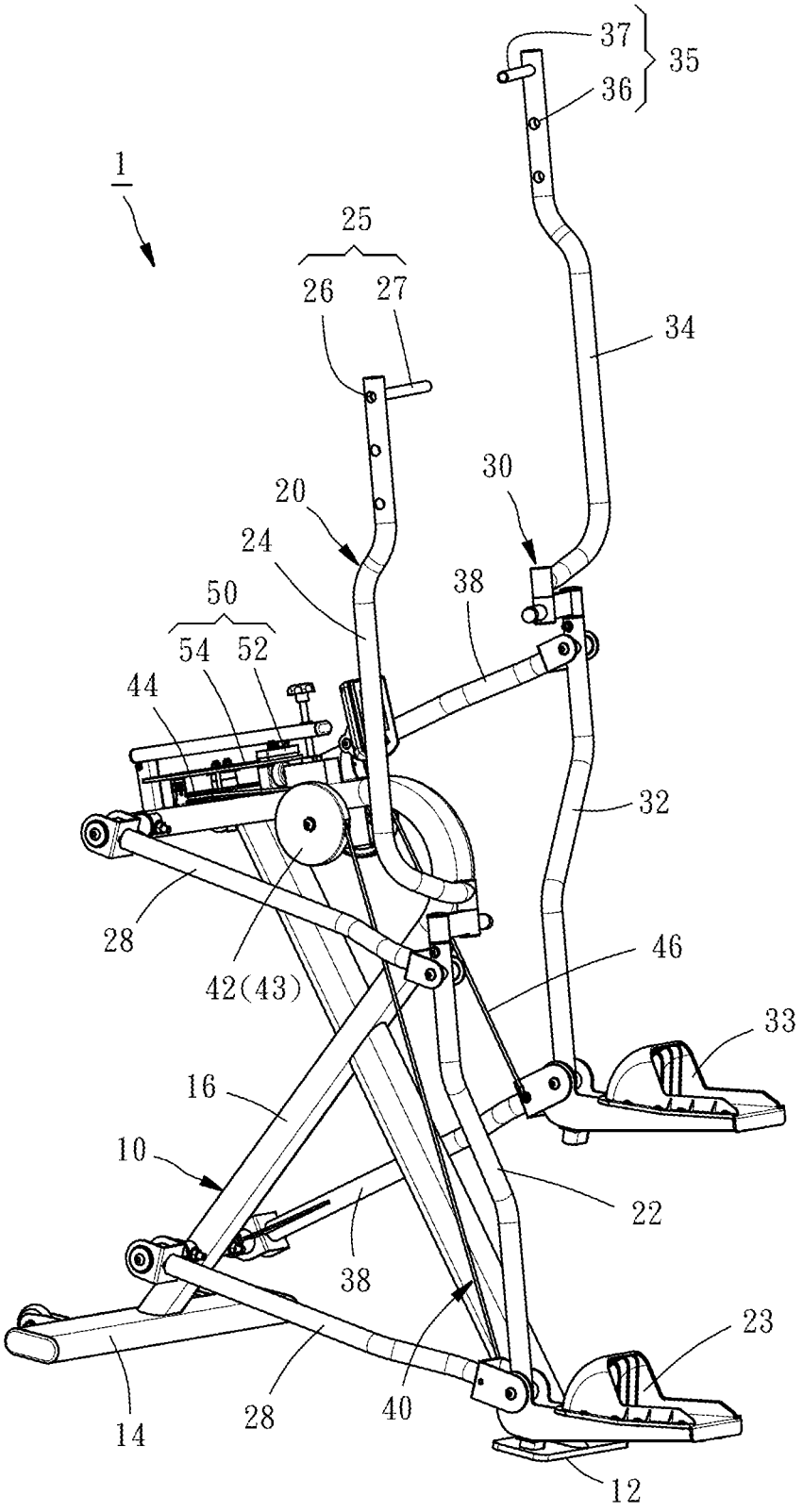
FIG. 1 is a perspective view of a climbing exerciser according to an embodiment of the present invention.
Figure 2:
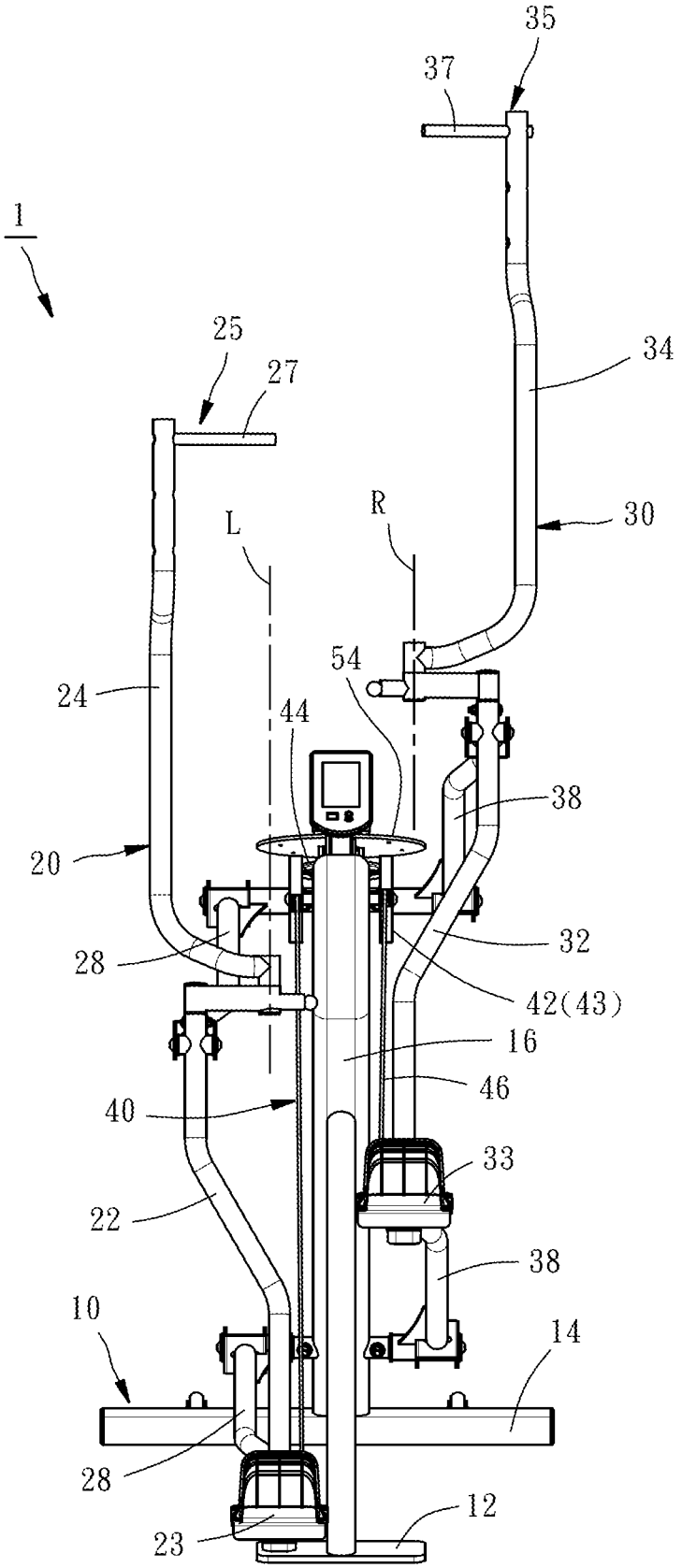
FIG. 2 is a front view of the climbing exerciser of the embodiment of the present invention, showing that the climbing exerciser is in a state of homolateral climbing movement.
Figure 3:
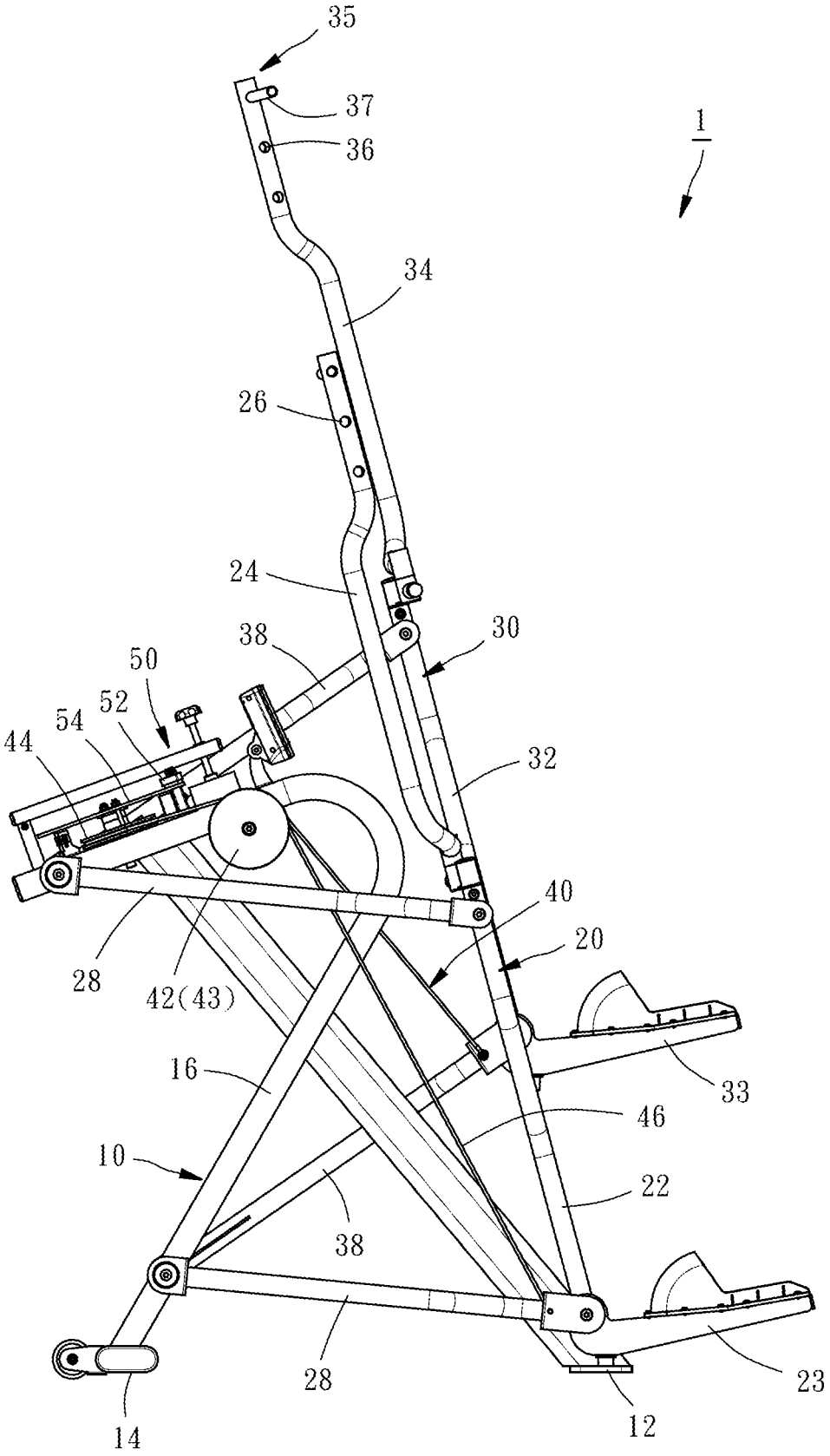
FIG. 3 is a lateral elevational view of the climbing exerciser of the embodiment of the present invention.

The structure and technical features of the present invention will be detailedly described hereunder by a preferred embodiment and accompany drawings. As shown in FIGS. 1-3, a climbing exerciser 1 provided by a preferred embodiment is composed of a base mount 10, a left rack 20, two left links 28, a right rack 30, two right links 38, and optionally a motion linking device 40 and a resistance device 50.

The base mount 10 has a front stand 12, a rear stand 14, and an upright stand 16 upwardly extending from the front stand 12 and the rear stand 14 and having a height approximately equal to the height of a user's chest or waist. By means of the front and rear stands 12 and 14, the base mount 10 can be stably placed on a floor, surface, or the like.

The left rack 20 is located at a left side of the upright stand 16 of the base mount 10 and provided with a lower left member 22 and an upper left member 24. To concisely illustrating the present invention, the left side and right side used in the specification are based on the view of FIG. 2, which are given by way of illustration only, and thus are not limitative of the present invention. The upper left member 24 is pivotally connected with a top end of the lower left member 22, such that the upper left member 24 is swivelable about a first imaginary axis L relative to the lower left member 22. The lower left member 22 and the upper left member 24 substantially extend along the first imaginary axis L that is slightly inclined forward relative to a vertical line (not shown) perpendicular to the floor. On a bottom of the lower left member 22, a left pedal 23 is provided for supporting a user's left foot. On an upper section of the upper left member 24, a left grip 25 is provided for being held by a user's hand. Various designs to the left grip 25 may be used. In this embodiment, the left upper member 24 is provided with three transversally extending holes 26, into one of which a left handlebar 27 is inserted to form the left grip 25. By inserting the left handlebar 27 into different transversally extending hole 26, the left grip 25 can be set at a different elevation to fulfill the user's requirement. In this embodiment, the transversally extending holes 26 are realized as through holes. In other embodiment, blind holes may serve as the transversally extending holes 26.

The two left links 28 each have a first end pivotally connected with the upright stand 16 of the base mount 10, and a second end opposite to the first end and pivotally connected with the lower left member 22 of the left rack 20. The two left links 28 are arranged one above the other and parallel to each other to enable that the left rack 20 is reciprocatingly moveable up and down relative to the base mount 10 along the first imaginary axis L approximately.

The right rack 30 is located at a right side of the upright stand 16 of the base mount 10. Similar to the left rack 20, the right rack 30 is provided with a lower right member 32 and an upper right member 34 that is pivotally connected with a top end of the lower right member 32, such that the upper right member 34 is swivelable about a second imaginary axis R relative to the lower right member 32. The lower right member 32 and the upper right member 34 substantially extend along the second imaginary axis R that is parallel to the first imaginary axis L. On a bottom of the lower right member 32, a right pedal 33 is provided for supporting a user's right foot. On an upper section of the upper right member 34, a right grip 35 is provided for being held by a user's hand. The right upper member 34 is provided with three transversally extending holes 36, into one of which a right handlebar 37 is inserted to form the right grip 35. By inserting the right handlebar 37 into different transversally extending hole 36, the right grip 35 can be set at a different elevation to fulfill the user's requirement. In this embodiment, the transversally extending holes 36 are realized as through holes. In other embodiment, the structure of the right grip 35 may be modified and blind holes may serve as the transversally extending holes 36.

The two right links 38 each have a first end pivotally connected with the upright stand 16 of the base mount 10, and a second end opposite to the first end and pivotally connected with the lower right member 32 of the right rack 30. The two right links 38 are arranged one above the other and parallel to each other to enable that the right rack 30 is reciprocatingly moveable up and down relative to the base mount 10 along the second imaginary axis R approximately.

The motion linking device 40 is disposed to the upright stand 16 of the base mount 10 and linked with the left rack 20 and the right rack 30 in such a way that the right rack 30 lowers when the left rack 20 raises, and vice versa. Various designs to the motion linking device 40 may be used. In this embodiment, the motion linking device 40 is composed of a plurality of pulleys 42 disposed to the upright stand 16 of the base mount 10, and a flexible member 46 wound around the pulleys 42. The pulleys 42 include two vertical pulleys 43 disposed at two lateral sides of the upright stand 16, and a transversal pulley 44 disposed at a top side of the upright stand 16. It is to be understood that the arrangement of the pulleys 42 may be modified according to an actual need, and thus not limitative of the present invention. The flexible member 46 has a first end connected with the lower one of the two left links 28, and a second end connected with the lower one of the two right links 38. For the flexible member 46, a cable, woven or nonwoven belt, chain, elongated member, or the like may be used. As such, the motion linking device 40 enables the left rack 20 and the right rack 30 to reciprocatingly move up and down in reverse directions. In other embodiment, the two ends of the flexible member 46 may be respectively connected with the left rack 20 and the right rack 30, or with the upper one of the two left links 28 and the upper one of the two right links 38, so as to achieve the same function of the motion linking device 40 in this embodiment. In other embodiment, the motion linking device 40 may be omitted, and in this circumstance the left rack 20 and the right rack 30 are operated independently.

The resistance device 50 is disposed to the upright stand 16 of the base mount 10 and coupled with the motion linking device 40 for providing adjustable resistance force to the motion linking device 40, such that a certain resistance force can be provided against the up and down motions of the left rack 20 and the right rack 30 so as to exercise the muscle of the user. For the resistance device 50, various commercially available structural designs may be used. In this embodiment, the resistance 50 uses a brake block 52, which is abutted against a circle disc 54 that is rotated along with the transversal pulley 44, to provide a required resistance force. In other embodiment, a pneumatic cylinder, hydraulic cylinder, spring or fluid damping device may serve as the resistance device 50 of the present invention. The resistance device 50 may be disposed between the base mount 10 and the left rack 20 or between the base mount 10 and the right rack 30 so as to provide a resistance force against movement of the left rack 20 or the right rack 30. In another embodiment, the resistance device 50 may be omitted.

With the above-mentioned structural design, the climbing exerciser 1 of the present invention can be operated by the user smoothly and quietly. In particular, the left rack 20 and the two left links 28, and the right rack 30 and the two right links 38 are connected together in a pivotally connecting manner, such that there will be no noisy sound generated because of low friction among the aforesaid structural elements while the climbing exerciser 1 is operated. Further, the moving traces of the left rack 20 and right rack 30 substantially follow along the first imaginary axis L and the second imaginary axis R, respectively, but on slightly bending curves. As such, the climbing exerciser 1 of the present invention can provide smooth and more natural movements to the user. Further, because the height of the base mount 10 is about equal to the heights of the left lower member 22 and the right lower member 32 (the heights of the left lower member 22 and the right lower member 32 will change within a range when the climbing exerciser 1 is operated), none of any structural members will block the user's line of sight, such that the user can freely watch a displaying device, such as television screen, control panel, etc., which is disposed in front of the user when the user is doing exercise, thereby improving the disadvantages of the prior art and achieving the objectives of the present invention.

Figure 4:
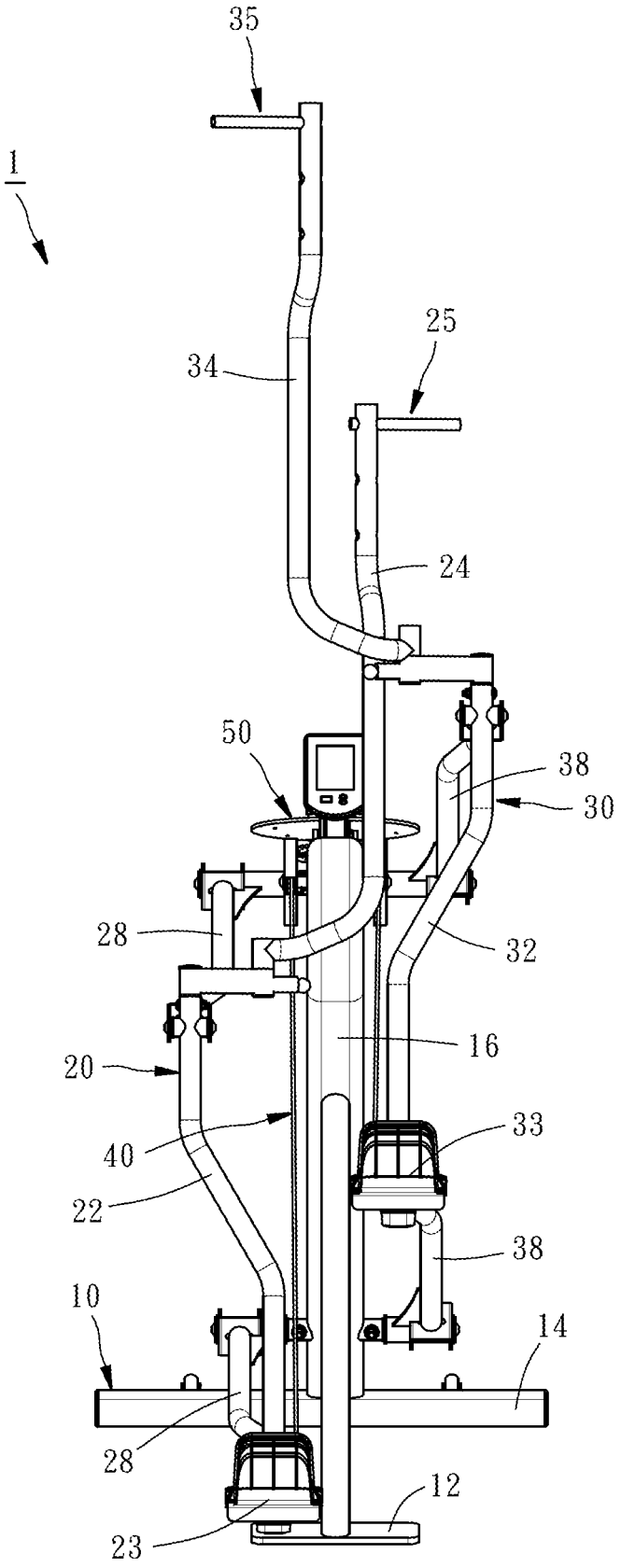
FIG. 4 is another front view of the climbing exerciser of the embodiment of the present invention, showing that the climbing exerciser is in a state of contralateral climbing movement.

In another aspect, the upper left member 24 is swivelable about the first imaginary axis L relative to the lower left member 22 between a first outer position, as shown in FIG. 2, and a first inner position, as shown in FIG. 4, and the upper right member 34 is swivelable about the second imaginary axis R relative to the lower right member 32 between a second outer position, as shown in FIG. 2, and a second inner position, as shown in FIG. 4. Therefore, the climbing exerciser 1 can be set in an exercise mode of homolateral climbing movement, as shown in FIG. 2, or in an exercise mode of contralateral climbing movement, as shown in FIG. 4. Specifically, FIG. 2 shows that the left grip 25 is spacedly located at a left side of the right grip 35 when the upper left member 24 stays at the first outer position and the upper right member 34 stays at the second outer position. In this exercise mode, the left and right hands of the user can hold the left and right grips 25 and 35, respectively, to do homolateral climbing movement. That is, the hand and foot at the homolateral side of the user's body synchronously move up and down. FIG. 4 shows that the left grip 25 is spacedly located at a right side of the right grip 35 when the upper left member 24 stays at the first inner position and the upper right member 34 stays at the second inner position. In this exercise mode, the left and right hands of the user can hold the right and left grips 35 and 25, respectively, to do contralateral climbing movement. That is, the hand and foot at the contralateral side of the user's body synchronously move up and down. In other words, by simply swiveling the upper left member 24 and the upper right member 34, the climbing exerciser 1 can adjust its structure to shift its exercise mode from one to another, thereby achieving the objective of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A climbing exerciser comprising:

a base mount;

a left rack located at a left side of the base mount;

two left links each having a first end pivotally connected with the base mount, and a second end pivotally connected with the left rack in a way that the left rack is reciprocatingly moveable up and down relative to the base mount;

a right rack located at a right side of the base mount; and two right links each having a first end pivotally connected with the base mount, and a second end pivotally connected with the right rack in a way that the right rack is reciprocatingly moveable up and down relative to the base mount, wherein the two left links are parallel to each other during an entire course of an up-and-down movement of the left rack, and the two right links are parallel to each other during an entire course of an up-and-down movement of the right rack; further comprising a motion linking device disposed to the base mount and linked with the left rack and the right rack in a way that the right rack lowers when the left rack raises; wherein the motion linking device comprises a plurality of pulleys disposed to the base mount, and a flexible member wound around the plurality of pulleys in a way that the flexible member has a first end connected with the left rack or one of the two left links, and a second end connected with the right rack or one of the two right links.

2. The climbing exerciser as claimed in claim 1, wherein the left rack comprises a lower left member pivotally connected with the two left links, and an upper left member provided with a left grip and pivotally connected with the lower left member in a way that the upper left member is swivelable relative to the lower left member between a first outer position and a first inner position; the right rack comprises a lower right member pivotally connected with the two right links, and an upper right member provided with a right grip and pivotally connected with the lower right member in a way that the upper right member is swivelable relative to the lower right member between a second outer position and a second inner position; the climbing exerciser is configured in a way that the left grip is spacedly located at a left side of the right grip when the upper left member stays at the first outer position and the upper right member stays at the second outer position, or in a way that the left grip is spacedly located at a right side of the right grip when the upper left member stays at the first inner position and the upper right member stays at the second inner position.

3. The climbing exerciser as claimed in claim 2, wherein the upper left member is provided with a transversally extending hole, into which a left handlebar is inserted to form the left grip.

4. The climbing exerciser as claimed in claim 3, wherein the transversally extending hole of the upper left member is a through hole.

5. The climbing exerciser as claimed in claim 2, wherein the upper left member is swivelable about a first imaginary axis relative to the lower left member, and the upper right member is swivelable about a second imaginary axis relative to the lower right member; the first imaginary axis is parallel to the second imaginary axis.

6. The climbing exerciser as claimed in claim 5, wherein the first imaginary axis is parallel to the left rack, and the second imaginary axis is parallel to the right rack.

7. The climbing exerciser as claimed in claim 2, wherein the lower left member is provided with a left pedal, and the lower right member is provided with a right pedal.

8. The climbing exerciser as claimed in claim 2, wherein the base mount has a height equal to heights of the left lower member and the right lower member.

9. The climbing exerciser as claimed in claim 1, further comprising a resistance device disposed to the base mount to provide a resistance force against movements of the left rack and the right rack.

* * * * *